US008491270B2

(12) United States Patent
Eguchi et al.

(10) Patent No.: US 8,491,270 B2
(45) Date of Patent: Jul. 23, 2013

(54) VEHICLE HEAT-EXCHANGE MODULE

(75) Inventors: Tsuyoshi Eguchi, Tokyo (JP); Atsusi Suzuki, Tokyo (JP); Yoshinao Komatsu, Tokyo (JP); Seiji Sato, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/264,644

(22) PCT Filed: Sep. 10, 2010

(86) PCT No.: PCT/JP2010/065610

§ 371 (c)(1),
(2), (4) Date: Oct. 14, 2011

(87) PCT Pub. No.: WO2011/048884

PCT Pub. Date: Apr. 28, 2011

(65) Prior Publication Data

US 2012/0031591 A1 Feb. 9, 2012

(30) Foreign Application Priority Data

Oct. 19, 2009 (JP) ..... 2009-240385

(51) Int. Cl.
*F01D 5/14* (2006.01)

(52) U.S. Cl.
USPC ..... 416/235; 416/236 R

(58) Field of Classification Search
USPC ..... 415/228, 235; 416/228, 235, 236 R, 416/237
See application file for complete search history.

(56) References Cited

U.S. PATENT DOCUMENTS

| | | | | |
|---|---|---|---|---|
| 2,150,299 | A * | 3/1939 | Telfer | 416/236 R |
| 4,189,281 | A | 2/1980 | Katagiri et al. | |
| 5,513,951 | A | 5/1996 | Komoda et al. | |
| 5,577,888 | A | 11/1996 | Capdevila et al. | |
| 6,398,492 | B1 | 6/2002 | Cho et al. | |
| 2003/0161728 | A1 | 8/2003 | Cho et al. | |

(Continued)

FOREIGN PATENT DOCUMENTS

| | | | |
|---|---|---|---|
| JP | 53-077321 | A | 7/1978 |
| JP | 61-132430 | U | 8/1986 |

(Continued)

OTHER PUBLICATIONS

International Search Report of PCT/JP2010/065610, mailing date Nov. 16, 2010.

(Continued)

*Primary Examiner* — Dwayne J White
(74) *Attorney, Agent, or Firm* — Westerman, Hattori, Daniels & Adrian, LLP

(57) ABSTRACT

In a vehicle heat-exchange module in which a fan unit is provided at the downstream side of a rectangular heat exchanger, and the fan unit is provided with a shroud having a bell-mouth and an annular opening, a propeller fan that is disposed in the annular opening, and a fan motor that rotationally drives the propeller fan, the fan unit is a unit having a single-fan configuration in which motor input power is at a predetermined level or less, and the propeller fan is provided with two sets of winglets that are respectively constructed upright, with a prescribed gap therebetween in the radial direction, along the circumferential direction on both a pressure surface and a suction surface of the root side of the blades.

8 Claims, 4 Drawing Sheets

U.S. PATENT DOCUMENTS

| | | | | |
|---|---|---|---|---|
| 2007/0031250 | A1* | 2/2007 | Suzuki et al. | 415/220 |
| 2007/0031257 | A1 | 2/2007 | Suzuki et al. | |
| 2010/0158713 | A1 | 6/2010 | Suzuki et al. | |

FOREIGN PATENT DOCUMENTS

| | | | |
|---|---|---|---|
| JP | 6-336999 | A | 12/1994 |
| JP | 2000-501808 | A | 2/2000 |
| JP | 2000-205194 | A | 7/2000 |
| JP | 2001-132453 | A | 5/2001 |
| JP | 2003-161299 | A | 6/2003 |
| JP | 2003-254297 | A | 9/2003 |
| JP | 2007-040197 | A | 2/2007 |
| JP | 2007-040202 | A | 2/2007 |
| JP | 4191432 | B2 | 12/2008 |
| JP | 2009-074462 | A | 4/2009 |

OTHER PUBLICATIONS

Written Opinion of PCT/JP2010/065610, mailing date Nov. 16, 2010.

* cited by examiner

VEHICLE HEAT-EXCHANGE MODULE

TECHNICAL FIELD

The present invention relates to a vehicle heat-exchange module in which a radiator for cooling an engine and/or a condenser for an air-conditioning device mounted on a vehicle and a fan unit are integrated into a module.

BACKGROUND ART

Known vehicle heat-exchange modules include one in which a condenser for an air-conditioning device and/or a radiator for cooling an engine, a propeller fan, a fan motor, and so forth are arranged in the front part of an engine compartment in this order from the front side and are integrated into a module (also referred to as a CRFM). This CRFM is configured by providing a shroud having a flow channel, whose cross-sectional area is gradually reduced towards the propeller fan facing the downstream side of the condenser and/or the radiator, such that the cooling air (outside air) sucked-in through the condenser and/or the radiator is guided to the propeller fan.

In such a CRFM, one or two propeller fans are provided depending on the amount of heat exchanged at the condenser and the radiator. In general, for a condenser and a radiator having a horizontally oriented rectangular shape, a single-fan configuration provided with one propeller fan is employed if the airflow rate, for a fan motor voltage of 12 V, is approximately 2,000 $m^3$/h or less, and a double-fan configuration provided with two propeller fans is employed if the airflow rate is 2,000 $m^3$/h or more. In addition, if the airflow rate is about 2,000 $m^3$/h, the fan motor input power is approximately 240 W or less.

In the case of the double-fan configuration, because the wind speed distribution of the cooling air flowing through the heat exchangers (the condenser and the radiator) is made uniform in comparison with the single-fan configuration, the pressure drop at the heat exchanger is not increased, the motor input power is not increased, and the input power per fan motor is reduced; therefore, there are some advantages, such as the ability to make the fan motor compact and lightweight, which facilitates the procurement thereof, and so forth. However, because two propeller fans and fan motors are required, the number of parts is increased, and although the respective weights of the fans are reduced, the total weight is increased. Furthermore, because the fan motor accounts for a large proportion of the cost of the fan unit, although the cost per motor is reduced, the total cost, including the cost of the two motors, becomes high.

On the other hand, various problems such as an increase in the motor input power, upgrading of the fan motor associated therewith, an increase in noise, and so forth are caused if the single-fan configuration is employed instead of the double-fan configuration, which should normally be employed, because a deviation is caused in the wind speed distribution of the air flowing through the heat exchanger, and the pressure drop (ventilation resistance) due to the heat exchanger is increased. In addition, PTLs 1 and 2 show configurations in which a drop in fan efficiency is suppressed by making a motor support beam have a stator-blade shape. In addition, PTL 3 shows a configuration in which an opening is provided at the periphery of the bell-mouth of the shroud in order to suppress a drop in cooling performance while driving due to the reduction in a ventilation area of the shroud. Furthermore, PTLs 4 to 6 show multi-blade configurations in which the number of blades is increased in order to make the depth dimension (axial dimension) of a propeller fan smaller.

In addition, PTLs 5 and 6 show configurations in which winglets are provided on the suction surface and the pressure surface in the vicinity of the outer periphery and the root part of the blade, respectively, thereby rectifying the airflow and suppressing separation, stalling, and so forth at the blade surface to achieve an improvement in fan efficiency. Furthermore, PTL 7 shows a configuration in which noise is reduced by lowering the rotational speed and making the flow distribution of cooling air uniform in the circumferential direction by forming a bell-mouth at the maximum size that permits the whole perimeter thereof to be secured within the shroud and making the propeller fan have as large a diameter as possible.

CITATION LIST

Patent Literature

{PTL 1} Japanese Translation of PCT International Application, Publication No. 2000-501808 (see FIGS. 3 and 4)

{PTL 2} Japanese Unexamined Patent Application, Publication No. 2003-161299 (see FIGS. 1 and 2)

{PTL 3} Japanese Unexamined Utility Model Application, Publication No. SHO 61-132430 (see FIGS. 1 and 2)

{PTL 4} Japanese Unexamined Patent Application, Publication No. HEI 6-336999 (see FIG. 1)

{PTL 5} Japanese Unexamined Patent Application, Publication No. 2007-40197 (see FIG. 1)

{PTL 6} Japanese Unexamined Patent Application, Publication No. 2007-40202 (see FIGS. 4 and 5)

{PTL 7} the Publication of Japanese Patent No. 4191432 (see FIGS. 1 and 2)

SUMMARY OF INVENTION

Technical Problem

As described above, in a conventional vehicle heat-exchange module, in general, the double-fan configuration is employed if the airflow rate exceeds approximately 2,000 $m^3$/h for a motor voltage of 12 V, and at this time, the fan motor input power is approximately 240 W or less. In this case, although the procurement of the fan motor is easy because of its small size, in comparison with the single-fan configuration, increases in the number of parts, in the total weight, and in the total cost cannot be avoided. Therefore, from the viewpoint of weight saving, cost saving, etc. of a vehicle heat-exchange module, there is a demand for a vehicle heat-exchange module having a single-fan configuration that can coping with a fan motor input power at the 240 W level or less and an airflow rate of exceeding 2,000 $m^3$/h.

However, if the double-fan configuration is simply changed to the single-fan configuration, a deviation is caused in the wind speed distribution of the air flowing through the heat exchanger, which causes an increase in the pressure drop (ventilation resistance) due to the heat exchanger, and in turn, leads to increased motor input power and noise. In addition, as a result of the increase in the motor input power, there will be a need to upgrade the fan motor, and thus, there are disadvantages such as weight, cost, availability, and so forth. Furthermore, if the single-fan configuration is employed, the speed of the airflow flowing through a propeller fan is increased, and thereby, the motor input is increased due to a drop in the fan efficiency, and the noise is increased. In addition, because various problems, such as a reduction in the engine cooling performance during driving etc., are caused by the reduced flow rate of the cooling air due to the reduction in the opening of the shroud, in other words, the reduction in the ventilation area, how to solve these problems becomes an issue.

The present invention has been conceived in light of the above-described circumstances, and an object thereof is to provide a vehicle heat-exchange module that is capable of coping with a CRFM etc. in which a fan unit having a single-fan configuration, whose motor input power is at a predetermined level or less, is used and which has an airflow rate exceeding approximately 2,000 $m^3$/h.

Solution to Problem

In order to solve the problems described above, a vehicle heat-exchange module according to the present invention employs the following solutions.

That is, a vehicle heat-exchange module according to the present invention includes a rectangular heat exchanger and a fan unit provided at the downstream side of the heat exchanger, wherein the fan unit is provided with a shroud having a bell-mouth and an annular opening, a propeller fan that is disposed in the annular opening of the shroud, and a fan motor that rotationally drives the propeller fan, wherein the fan unit is a unit having a single-fan configuration in which fan motor input power is at a predetermined level or less, and wherein the propeller fan is provided with at least two sets of winglets that are respectively constructed upright, with a prescribed gap therebetween in the radial direction, along the circumferential direction on both a pressure surface and a suction surface of a root side of a blade.

According to the present invention, the vehicle heat-exchange module consists of a rectangular heat exchanger, a fan unit provided at the downstream side of the heat exchanger, the fan unit being a unit having a single-fan configuration in which the fan motor input at a predetermined level or less, and the propeller fan is configured with at least two sets of winglets that are respectively constructed upright, with a prescribed gap therebetween in the radial direction, along the circumferential direction on both of a pressure surface and a suction surface of the root side of the blade; therefore, even under operating conditions involving a high airflow rate and large pressure drop where a fan unit having the single-fan configuration whose motor input power is at a predetermined level or less is used, it is possible to suppress separation at the blade surface, stalling, and so forth and to overcome a reduction in the aerodynamic performance, an increase in noise, and so forth with at least two sets of winglets that are provided on both a pressure surface and a suction surface of the root side of the blade. Therefore, it is possible to cope with a vehicle heat-exchange module in which a fan unit having the single-fan configuration whose motor input power is at a predetermined level or less is used and in which the airflow rate exceeds approximately 2,000 $m^3$/h, and weight-saving, cost reduction, simpler parts procurement, and so forth of the module can be achieved.

According to the vehicle heat-exchange module of the present invention, the fan motor may be supported on the shroud via a motor support beam at the downstream side of the propeller fan, and the motor support beam may have a stator-blade shape.

According to this configuration, because the fan motor is supported by the shroud via the motor support beam on the downstream side of the propeller fan, and the motor support beam has a stator-blade shape, by using the fan unit having the single-fan configuration, in the vehicle heat-exchange module in which the operating conditions involve a high airflow rate and a large pressure drop, it is possible to recover the static pressure from a part of the dynamic pressure at the outlet of the propeller fan by making the motor support beam have a stator-blade shape, and to suppress a drop in fan efficiency. Therefore, it is possible to reduce the motor input power, which serves to prevent having to upgrade the fan motor.

According to the vehicle heat-exchange module described above, the solidity of the blade part of the motor support beam having the stator-blade shape may be set to be approximately unity.

According to this configuration, the solidity (chord-pitch ratio=blade chord length/pitch) of the blade part of the motor support beam having the stator-blade shape is set to be approximately unity; therefore, it is possible to suitably redirect the high-speed airflow flowing out from the propeller fan and to effectively recover the static pressure from a part of the dynamic pressure at the outlet of the propeller fan. Therefore, the drop in the fan efficiency due to the single-fan configuration can be effectively overcome.

According to any one of the vehicle heat-exchange modules described above, the number of blades of the propeller fan may be at least nine, and the number of the stator blades that may be formed by the motor support beam is at least ten.

According to this configuration, because the number of blades of the propeller fan is at least nine, and the number of the stator blades formed by the motor support beam is at least ten, by setting the number of blades of the propeller fan and the number of stator blades of the motor support beams made to have a stator-blade shape to be at least nine and at least ten, respectively, it is possible to make the depth dimension (axial dimension) of the fan unit, and in turn, that of the heat-exchange module, sufficiently small. Therefore, even though the stator blades are added, it is possible to achieve advantages such as weight-saving, cost reduction, and so forth brought about by the single-fan configuration without deteriorating the mountability to a vehicle or the ease of layout. In addition, because the numbers of blades in the fan and of the stator blades are set so as to be coprime, it is possible to prevent an increase in discrete frequency noise caused by pressure interference in a specific frequency range and to reliably suppress fan noise.

In addition, according to the vehicle heat-exchange module of the present invention, a cutout that increases a ventilation area may be provided around the bell-mouth in the shroud.

According to this configuration, because the cutout that increases the ventilation area is provided around the bell-mouth in the shroud, it is possible to increase the ventilation area of the shroud, which is reduced in the single-fan configuration, with the cutouts and to reduce the ventilation resistance due to the shroud. Therefore, it is possible to control the decrease in the engine cooling performance during traveling that is brought about by the single-fan configuration, and at the same time, to achieve further weight-saving of the shroud, and in turn of the heat-exchange module.

According to the vehicle heat-exchange module described above, the area of the cutout may be in the range of 10 to 30% of the area of the shroud from which the area of the annular opening is subtracted.

According to this configuration, because the area of the cutout is in the range of 10 to 30% of the area of the shroud from which the area of the annular opening is subtracted, it is possible to control, within the allowable range, the respective variations in the engine cooling performance during driving and the air conditioning performance during idling due to the variations in the flow-speed distribution of the airflow flowing through the heat exchanger, caused by employing the single-fan configuration. Therefore, it is possible to eliminate an impact on the engine cooling performance and the air conditioning performance, and to ensure the respective levels of performance.

In addition, according to the vehicle heat-exchange module of the present invention, the bell-mouth may be formed at the maximum size that permits the whole perimeter to be secured within the shroud.

According to this configuration, because the bell-mouth is formed at the maximum size that permits the whole perimeter to be secured within the shroud, it is possible to increase the diameter of the propeller fan as much as possible to reduce the number of revolutions of the fan, and to make the distribution of the airflow sucked into the fan in the circumferential direction uniform. Therefore, it is possible to reduce the noise, and at the same time, to suppress the generation of abnormal noise (NZ noise) of the blade passing frequency components, thus improving the sound characteristics.

Advantageous Effects of Invention

According to the present invention, even under operation conditions of high airflow rate and large pressure drop where a fan unit having single-fan configuration, whose motor input is at a predetermined level or less, is used, it is possible to overcome the reduction in the aerodynamic performance, the increase in noise, and so forth by providing at least two sets of winglets on both of a pressure surface and a suction surface of a root side of a blade, thereby suppressing separation, stalling, and so forth at the blade surfaces; therefore, it is possible to adequately cope with a vehicle heat-exchange module in which a fan unit having a single-fan configuration, whose motor input power is at a predetermined level or less, is used and in which the airflow rate exceeds approximately 2,000 $m^3$/h, and it is possible to achieve weight-saving, cost reduction, easy parts procurement, and so forth.

DESCRIPTION OF EMBODIMENTS

One embodiment of the present invention will be described below with reference to FIGS. 1 to 6.

Figure 1:
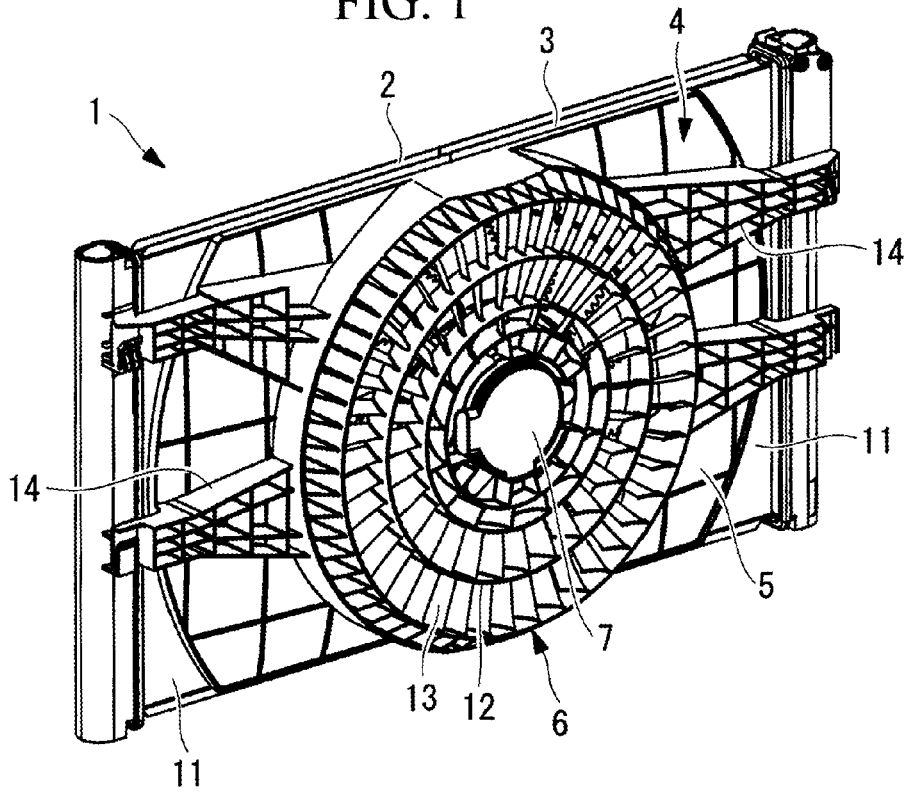
FIG. 1 is a perspective view, as seen from the downstream side of the airflow direction, showing a vehicle heat-exchange module according to one embodiment of the present invention.
Figure 2:
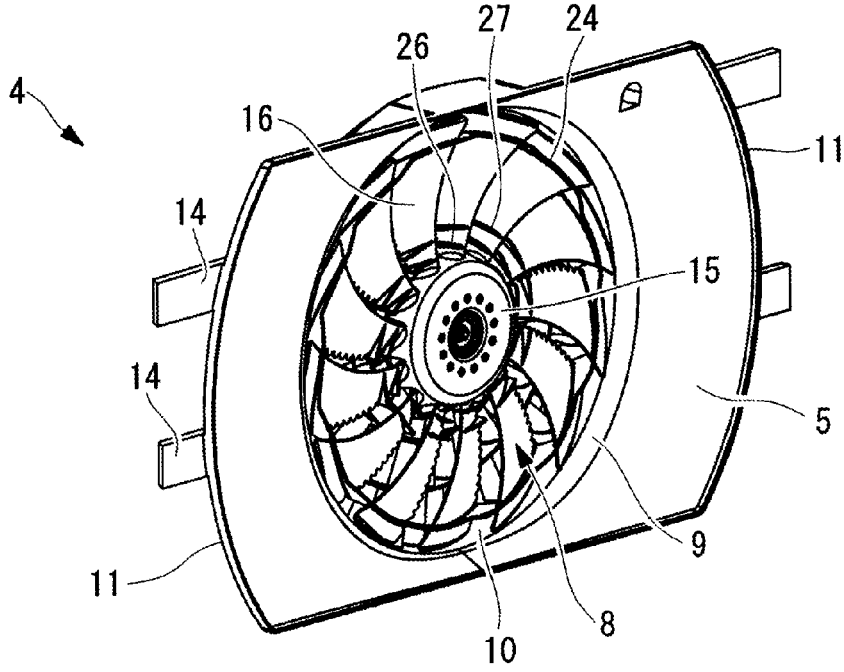
FIG. 2 is a perspective view showing only a fan unit that is removed from the vehicle heat-exchange module shown in FIG. 1, as seen from the upstream side of the fan.

FIG. 1 is a perspective view taken from the downstream side of an airflow direction showing a vehicle heat-exchange module according to one embodiment of the present invention, and FIG. 2 is a perspective view showing only a fan unit that is removed from the vehicle heat-exchange module, taken from the upstream side of the fan.

A vehicle heat-exchange module 1 is formed by combining a condenser 2 for an air-conditioning device, a radiator 3 for cooling engine cooling water, and a fan unit 4, which are arranged in a sequence along the airflow direction, into an integral module through brackets etc., and has a specification that requires an airflow rate of approximately 2,000 $m^3$/h or more on the basis of, for example, the amount of heat to be exchanged at the condenser 2 and the radiator 3. Hereinafter, this module 1 may also be referred to simply as a CRFM 1.

The CRFM 1 is often disposed at the front side in an engine compartment of a vehicle so as to face a front-grille, and it is desirable to reduce the depth dimension as much as possible and to reduce the weight from the viewpoint of mountability to a vehicle, ease of layout in the engine compartment, or the like. In addition, because the vertical dimension is limited in a low vehicle, a module having a generally horizontally oriented rectangular shape is often employed. Therefore, a thin heat exchanger having a horizontally oriented rectangular shape and a relatively large front-face surface is used in the condenser 2 and the radiator 3. Hereinafter, the condenser 2 and the radiator 3 may also generically be referred to simply as a heat exchanger.

The fan unit 4 is integrally assembled at the downstream side of the condenser 2 and the radiator 3. This fan unit 4 is provided with a shroud 5 that guides the cooling air (outside air) that has passed through the condenser 2 and the radiator 3 to a propeller fan 8, motor support beams 6 integrally formed with the shroud 5, a fan motor 7 that is fixedly supported with these motor support beams 6, and the propeller fan 8 that is attached to a rotating shaft (not shown) of the fan motor 7 and is rotationally driven. In addition, this fan unit 4 is assumed to be, for example, a fan unit 4 with a single-fan configuration using a single propeller fan 8 that is rotationally driven by the fan motor 7 with an input power at the level of 240 W or less for a fan motor voltage of 12 V, and has a configuration in which the airflow rate exceeds approximately 2,000 $m^3$/h.

The shroud 5 is an integrally molded resin part that has a configuration in which a front opening has an outer periphery of substantially the same shape as the external shape of the radiator 3, a bell-mouth 9 and an annular opening 10 are provided at an approximately central portion of the front opening, and the cross-sectional area of the flow channel is sharply reduced from the front opening towards the bell-mouth 9 and the annular opening 10. The ventilation area in the shroud 5 is increased by providing a plurality of cutouts 11 at both left-side and right-side end portions of the shroud 5. The total area of these cutouts 11 is in the range of 10 to 30% of the area of the shroud 5 from which the area of the annular opening 10 is subtracted.

In addition, the bell-mouth 9 provided in the shroud 5 and the annular opening 10 continuously linked therewith are formed at the maximum size that permits the whole perimeter to be secured within the shroud 5. Further, the motor support beams 6 for fixedly supporting the fan motor 7 are integrally molded into the shroud 5. These motor support beams 6 consist of a plurality of sets of rings 12 provided concentrically, numerous (at least ten) radial spokes 13 that connect a plurality of sets of rings 12, reinforcing ribs 14, and so forth.

These numerous spokes 13 constituting the motor support beams 6 all have stator-blade shapes in order to reduce the motor input power. The solidity (chord-pitch ratio=blade chord length/pitch) of the blade part of these stator-blade shaped spokes 13 is set to be about unity. In addition, the flat-shaped thin fan motor 7 is securely arranged at the central part of these motor support beams 6.

The propeller fan 8 is configured as a multi-blade propeller fan having a small depth dimension, in which a hub 15 is provided at the central part, and at least nine (in this embodiment, thirteen) blades 16 are disposed on the outer circumference of this hub 15. This propeller fan 8 is configured such that the hub 15 is fixed to the rotating shaft (not shown) of the fan motor 7 so as to be driven rotationally in the annular opening 10 of the shroud 5.

Figure 3:
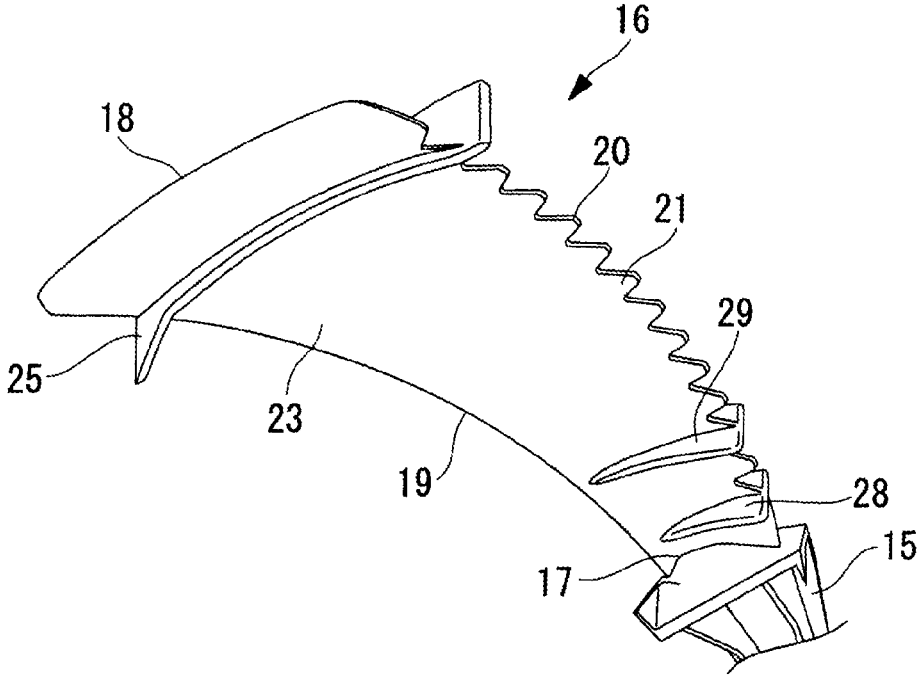
FIG. 3 is a perspective view showing a blade of a propeller fan that constitutes the fan unit shown in FIG. 2, as seen from the pressure surface side.
Figure 4:
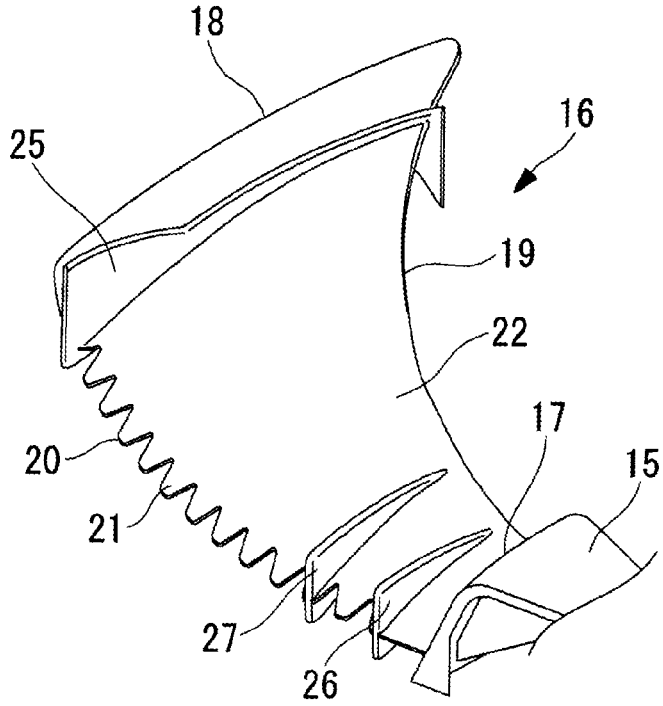
FIG. 4 is a perspective view showing a blade of a propeller fan that constitutes the fan unit shown in FIG. 2, as seen from the suction surface side.
Figure 5:
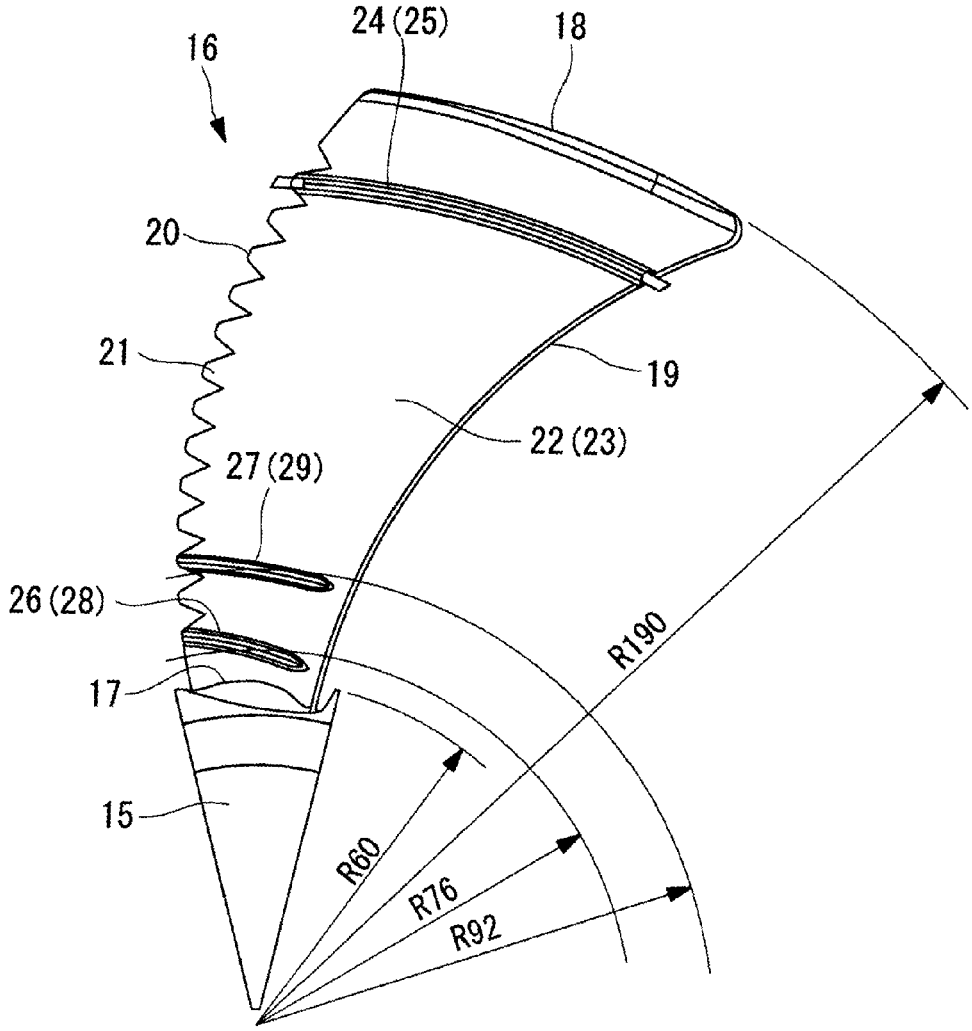
FIG. 5 is a configuration diagram showing placement positions of the root side winglets provided on the blade of the propeller fan shown in FIGS. 3 and 4.

As shown in FIGS. 3 to 5, each of the blades 16 of the propeller fan 8 is shaped such that the width in the circumferential direction is gradually widened from a base portion 17, which extends from the hub 15, towards an outer circumferential portion 18 in the radial direction. A leading edge 19 forming the front edge of this blade 16 in the rotating direction is curved convexly towards a trailing edge 20 that forms the rear edge, and at the same time, the trailing edge 20 is convexly curved in the direction away from the leading edge 19. The trailing edge 20 is provided with numerous serrations 21.

The blade 16 is a plate-like blade in which the camber is gradually increased from the outer circumferential portion 18 towards the base portion 17 and is configured so as to be disposed on the outer circumferential surface of the hub 15 with a prescribed angle in the circumferential direction such that, when the propeller fan 8 is rotated to the right in FIG. 2, the facing side of the drawing becomes a suction surface 22 and the other side of the drawing becomes a pressure surface 23, and the cooling air blows out from the facing side of the drawing towards the other side.

In addition, on each of the blades 16, winglets 24 and 25 are constructed upright on both the suction surface 22 and pressure surface 23 of the portion close to the outer circumferential portion 18 along the circumferential direction. With a configuration in which the adjacent blades 16 are connected to each other with these winglets 24 and 25 over the whole periphery, it is possible to achieve an increase in strength of the propeller fan 8. Similarly, at least two sets of winglets 26 and 27, and 28 and 29 with a prescribed gap therebetween in the radial direction are respectively constructed upright along the circumferential direction on both the suction surface 22 and the pressure surface 23 of the portions close to the base portion 17. These winglets 24 and 25 and winglets 26, 27, 28 and 29 are disposed such that they are constructed upright on the surface of the blade 16 between the vicinities of the leading edge 19 and the trailing edge 20, and the height from the surface of the blade 16 is increased gradually from the leading edge 19 side towards the trailing edge 20 side.

Further, for the winglets 24 and 25 and winglets 26, 27, 28 and 29, assuming that the dimension in the radial direction from the base portion 17 of the blade 16 to the outer circumferential portion 18 is 100, it is effective that the winglets 24 and 25 on the outer circumferential side be disposed within the dimensional range of 5 to 45% from the outer circumferential portion 18, and the winglets 26, 27, 28 and 29 on the root side be disposed within the dimensional range of 5 to 45% from the base portion 17.

As an example, as shown in FIG. 5, in the winglets 26, 27, 28 and 29 on the root side, if the outer circumferential dimension of the hub 15 is assumed to be R60 mm and the radial-direction dimension of the outer circumferential portion 18 of the blade 16 is assumed to be R190 mm, then the radial-direction dimension of the blade 16 (the radial-direction dimension from the base portion 17 to the outer circumferential portion 18) is 190-60=130 mm, and if the radial-direction dimension (representative value) of the inner winglets 26 (28) is assumed to be R76 mm, and the radial-direction dimension (representative value) of the outer winglets 27 (29) is assumed to be R92 mm, then the inner winglets 26 (28) are respectively positioned at (76−60)/130=12.5% position from the base portion 17, and the outer winglets 27 (29) are respectively positioned at (92−60)/130=25% position form the base portions 17.

With the configuration described above, this embodiment affords the following effects and advantages.

In the CRFM 1 described above, as it is driven by the fan motor 7 and the propeller fan 8 is rotated, the cooling air (outside air) is sucked from the front surface of the condenser 2 through the condenser 2 and the radiator 3. After passing through the condenser 2 and the radiator 3, this outside air is guided to the propeller fan 8 rotated in the annular opening 10 that is continuously linked with the bell-mouth 9 by the shroud 5 of the fan unit 4 and is blown out to the downstream side by the propeller fan 8 through the annular opening 10. During this process, the coolant and the engine cooling water are cooled in the condenser 2 and the radiator 3 via heat exchange with the outside air.

Here, for example, when the above configuration is applied to the vehicle heat-exchange module 1 (the CRFM 1), whose airflow rate exceeds 2,000 $m^3$/h under conditions of where the voltage of the fan motor 7 is 12 V, not only is the airflow rate through the propeller fan 8 increased, but also the pressure drop (ventilation resistance) of the heat exchanger is increased due to a deviation caused in the wind speed distribution of the airflow flowing through the heat exchanger (the condenser 2 and the radiator 3). Therefore, the operating conditions involve a high airflow rate and a large pressure drop, and problems such as deterioration of aerodynamic performance and an increase in noise, an increase in motor input power, a drop in fan efficiency, and so forth are caused in association with the flow separation and stalling at the blade surface of the propeller fan 8.

However, according to this embodiment, with the winglets 24 and 25 that are provided on the outer circumferential portion 18 side of both of the suction surface 22 and the pressure surface 23 of each of the blades 16 of the propeller fan 8, a leakage flow from the pressure surface 23 to the suction surface 22 generated at the gap between the outer circumferential portion 18 of the blade 16 and the shroud 5 (tip clearance) due to the pressure difference between the pressure surface 23 and the suction surface 22 of the blade is prevented from approaching the main stream, and, at the same time, the radial flow due to the centrifugal force is also prevented, thereby allowing the airflow to efficiently flow out to the downstream side by means of the adjacent blade 16. In addition, with the at least two sets of winglets 26, 27, 28 and 29 that are provided, with a prescribed gap therebetween, on the base portion 17 side of the suction surface 22 and the pressure surface 23 of each of the blades 16, separation of the airflow at the root side surface of the blade 16 (the suction surface 22 and the pressure surface 23) and a turbulent flow due to the radial spread of the separated flow due to the centrifugal force are controlled, and it is thus possible to prevent a deterioration of the aerodynamic performance and an increase in noise.

Therefore, flow separation, stalling, deterioration of aerodynamic performance and noise associated therewith, an increase in motor input power, a drop in fan efficiency, and so forth at the blade surface of the propeller fan 8, which are caused when the fan unit 4 having the single-fan configuration in which the input power is 240 W or less for a fan motor voltage of 12 V is applied to the vehicle heat-exchange module 1 (the CRFM 1) whose airflow rate exceeds 2,000 $m^3$/h, are suppressed, and it is possible to extend the range of applications of the fan unit 4 having the single-fan configuration using a small, lightweight, and low-cost fan motor 7 in which the motor input is at a predetermined level or less to the vehicle heat-exchange module 1 whose airflow rate exceeds approximately 2,000 $m^3$/h, and it is possible to achieve weight-saving, cost reduction, simpler procurement, and so forth.

In addition, because the numerous spokes 13 of the motor support beams 6 that support the above-described fan motor 7 at the downstream side of the propeller fan 8 are made to have a stator-blade shape, and because the solidity (chord-pitch ratio=blade chord length/pitch) of that stator-blade shaped blade is set to be around unity, by configuring the fan unit 4 to have the single-fan configuration, it is possible to suitably redirect the high-speed airflow flowing out from the propeller fan 8 in the vehicle heat-exchange module 1 whose operating conditions involve a high airflow rate and a large pressure drop, thereby effectively recovering the static pressure from a part of the dynamic pressure at the outlet of the propeller fan 8. Therefore, the drop in the fan efficiency due to the single-fan configuration can be effectively overcome, and it is possible to avoid upgrading the fan motor 7 due to the increase in the motor input power.

In addition, because the number of the blades 16 constituting the propeller fan 8 is at least nine, and furthermore, because the number of the stator blades formed by making the spokes 13 of the motor support beams 6 have a stator-blade shape is at least ten in this embodiment, by achieving the multi-blade configuration by setting the number of blades of the propeller fan 8 and the number of stator blades of the motor support beams 6 made to have a stator-blade shape to be at least nine and at least ten, respectively, it is possible to make the depth dimension (axial dimension) of the fan unit 4, and in turn, that of the vehicle heat-exchange module 1, sufficiently small; therefore, even though the stator blades are added, it is possible to achieve advantages such as weight-saving, cost reduction, and so forth brought about by the single-fan configuration without deteriorating the mountability to a vehicle and the ease of layout. Further, because the number of the blades of the propeller fan 8 and the number of the stator blades formed by the motor support beams 6 are set so as to be coprime, it is possible to prevent an increase in discrete frequency noise caused by pressure interference in a specific frequency range, allowing fan noise to be reliably suppressed.

In addition, because the cutouts 11 that increase the ventilation area are provided around the bell-mouth 9 in the shroud 5, and the area of these cutouts 11 is set to be in the range from 10 to 30% of the area of the shroud 5 from which the area of the annular opening 10 is subtracted, by increasing the ventilation area of the shroud 5, which is reduced in the single-fan configuration, with the cutouts 11 and by reducing the ventilation resistance due to the shroud 5, it is possible to control, within allowable ranges, variations in the engine cooling performance during driving and variations in the air conditioning performance during idling, which are caused by variations in the flow-speed distribution of the airflow flowing through the heat exchanger (the condenser 2 and radiator 3) as a result of employing the single-fan configuration.

Figure 6:
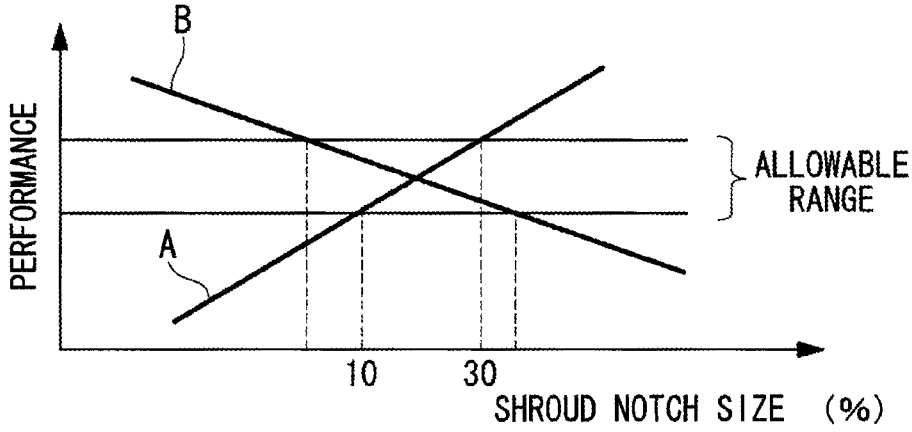
FIG. 6 is an explanatory diagram showing an allowable range for the amount of cutout provided on a shroud that constitutes the fan unit shown in FIG. 2.

In other words, as shown in FIG. 6, in the relationship between the cutout amount of the shroud 5 by the cutouts 11, and the engine cooling performance and the air conditioning performance, as the cutout amount increases, the engine cooling performance during driving increases as in line A, and on the other hand, the air conditioning performance during idling decreases as in line B, and by setting the area of the cutouts 11 within the range of 10 to 30% of the area of the shroud 5 from which the area of the annular opening 10 is subtracted, it is possible to control variations in the engine cooling performance during driving and the air conditioning performance during idling to within the allowable ranges, respectively, and to ensure the respective levels of performance. At the same time, with the cutouts 11, it is possible to achieve further weight-saving of the shroud 5, and in turn, of the vehicle heat-exchange module 1.

In addition, the bell-mouth 9 provided in the shroud 5 is formed at the maximum size that permits the whole perimeter to be secured within the shroud 5. Therefore, it is possible to increase, as much as possible, the diameter of the propeller fan 8 that is disposed in the annular opening 10 to reduce the number of revolutions of the fan and to make the distribution of the airflow sucked into the propeller fan 8 in the circumferential direction uniform, and thereby it is possible to reduce the noise and, at the same time, to control the generation of abnormal noise (NZ noise) of the blade passing frequency components, improving the sound characteristics.

The present invention is not restricted to the above-described embodiments according to the present invention. Suitable modifications can be made so long as they do not depart from the spirit thereof. For example, in the above-described embodiment, although an example in which the winglets 24 and 25 are provided on the outer-circumferential-end side of the blade 16, a configuration in which a ring is provided instead of these winglets 24 and 25 may be employed.

REFERENCE SIGNS LIST

1 vehicle heat-exchange module (CRFM)
2 condenser (heat exchanger)
3 radiator (heat exchanger)
4 fan unit
5 shroud
6 motor support beam
7 fan motor
8 propeller fan
9 bell-mouth
10 annular opening
11 cutout
13 spoke (stator-blade shape)
16 blade
17 base portion
22 suction surface
23 pressure surface
26, 27, 28, 29 winglet

The invention claimed is:

1. A vehicle heat-exchange module comprising a rectangular heat exchanger and a fan unit provided at the downstream side of the heat exchanger, wherein the fan unit is provided with a shroud having a bell-mouth and an annular opening, a propeller fan that is disposed in the annular opening of the shroud, and a fan motor that rotationally drives the propeller fan, wherein the fan unit is a unit having a single-fan configuration in which fan motor input power is at a predetermined level or less, and wherein the propeller fan is provided with a plurality of blades each having a pressure surface and a suction surface, each of the pressure surface and the suction surface of the blade is provided with at least two winglets with a prescribed gap therebetween in the radial direction, and each winglet is provided upright on the pressure surface or the suction surface of a root side of the blade, and along the circumferential direction.

2. A vehicle heat-exchange module according to claim 1, wherein the fan motor is supported on the shroud via a motor support beam at the downstream side of the propeller fan, and the motor support beam has a stator-blade shape.

3. A vehicle heat-exchange module according to claim 2, wherein the solidity of the blade part of the motor support beam having the stator-blade shape is set to be approximately unity.

4. A vehicle heat-exchange module according to claim 2, wherein the number of blades of the propeller fan is at least nine, and the number of the stator blades formed by the motor support beam is at least ten.

5. A vehicle heat-exchange module according to claim 1, wherein a cutout that increases a ventilation area is provided around the bell-mouth in the shroud.

6. A vehicle heat-exchange module according to claim 5, wherein the area of the cutout is in the range of 10 to 30% of the area of the shroud from which the area of the annular opening is subtracted.

7. A vehicle heat-exchange module according to claim 1, wherein the bell-mouth is formed at a maximum size that permits the whole perimeter to be secured within the shroud.

8. A vehicle heat-exchange module according to claim 1, wherein each of the pressure surface and the suction surface of the blade has an outer side winglet provided on the outer circumferential side of the blade, and each outer side winglet is provided upright on the pressure surface or the suction surface.

* * * * *